US012611748B2

(12) United States Patent
Annis

(10) Patent No.: US 12,611,748 B2
(45) Date of Patent: Apr. 28, 2026

(54) SANDING TOOL WITH INTERMEDIATE ADAPTER PAD

(71) Applicant: Full Circle International, Inc., Garfield, MN (US)

(72) Inventor: Kent V. Annis, Garfield, MN (US)

(73) Assignee: Full Circle International, Inc., Garfield, MN (US)

( * ) Notice: Subject to any disclaimer, the term of this patent is extended or adjusted under 35 U.S.C. 154(b) by 346 days.

(21) Appl. No.: 18/219,415

(22) Filed: Jul. 7, 2023

(65) Prior Publication Data

US 2024/0017374 A1 Jan. 18, 2024

Related U.S. Application Data

(60) Provisional application No. 63/389,495, filed on Jul. 15, 2022.

(51) Int. Cl.

| | |
|---|---|
| ***B24D 15/02*** | (2006.01) |
| ***B24B 7/18*** | (2006.01) |
| ***B24B 23/00*** | (2006.01) |
| ***B24B 41/047*** | (2006.01) |
| ***B24D 11/02*** | (2006.01) |
| ***B24D 15/04*** | (2006.01) |

(52) U.S. Cl.

CPC ..... *B24D 15/023* (2013.01); *B24B 7/186* (2013.01); *B24B 23/00* (2013.01); *B24B 41/047* (2013.01); *B24D 11/02* (2013.01); *B24D 15/04* (2013.01); *B24B 7/182* (2013.01); *B24B 7/184* (2013.01)

(58) Field of Classification Search

CPC ..... B24D 15/00; B24D 15/02; B24D 15/023; B24D 15/04; B24D 11/00; B24D 11/02; B24B 7/10; B24B 7/18; B24B 7/182; B24B 7/184; B24B 7/186; B24B 41/00; B24B 41/04; B24B 41/047

See application file for complete search history.

(56) References Cited

U.S. PATENT DOCUMENTS 4,062,152 A * 12/1977 Mehrer ..... B24D 15/00 451/344
4,071,981 A 2/1978 Champayne
4,616,449 A 10/1986 Marton
(Continued)

FOREIGN PATENT DOCUMENTS

DE 20016263 U1 10/2001
DE 19718497 B4 * 4/2010 ..... A47L 9/0483
(Continued)

*Primary Examiner* — C. A. Rivera
(74) *Attorney, Agent, or Firm* — Brooks, Cameron & Huebsch, PLLC

(57) ABSTRACT

Example implementations relate to a sanding tool having an intermediate adapter pad. The sanding tool includes a rigid base plate configured for releasable attachment to a number of sanding handles. The sanding tool also includes an adapter pad that comprises: an upper portion configured to receive the rigid base plate, the upper portion including a perimeter portion that extends above an upper surface of the rigid base plate; and a lower surface configured for releasable attachment to a lower pad, wherein a lower surface of the lower pad is configured for releasable attachment to a working material. The perimeter portion includes a channel configured to receive a bristle ring.

20 Claims, 6 Drawing Sheets

(56) References Cited

U.S. PATENT DOCUMENTS

| | | | | |
|---|---|---|---|---|
| 4,697,389 | A * | 10/1987 | Romine | B24D 15/02 451/354 |
| 4,899,495 | A | 2/1990 | Attinger et al. | |
| 5,138,735 | A | 8/1992 | Kusz et al. | |
| 5,239,783 | A * | 8/1993 | Matechuk | B24B 45/006 451/354 |
| 6,523,214 | B1 | 2/2003 | Kaiser | |
| 6,634,937 | B1 | 10/2003 | Edwards | |
| 7,040,973 | B1 * | 5/2006 | Kitts | B24D 15/04 451/524 |
| 7,488,242 | B2 | 2/2009 | Gringer et al. | |
| 7,632,174 | B2 | 12/2009 | Gringer et al. | |
| 7,815,494 | B2 | 10/2010 | Gringer et al. | |
| 7,927,192 | B2 | 4/2011 | Annis | |
| 8,285,291 | B2 | 10/2012 | Dinan et al. | |
| 8,572,797 | B2 | 11/2013 | Umbrell | |
| 10,369,683 | B2 | 8/2019 | Umbrell | |
| 2009/0124177 | A1 * | 5/2009 | Berryhill | B24B 55/10 451/524 |
| 2019/0143487 | A1 * | 5/2019 | Clifford | B24D 13/145 451/527 |

FOREIGN PATENT DOCUMENTS

| | | |
|---|---|---|
| EP | 0141139 B1 | 5/1985 |
| JP | 3230211 U | 1/2021 |

* cited by examiner

SANDING TOOL WITH INTERMEDIATE ADAPTER PAD

PRIORITY INFORMATION

This application claims priority of U.S. Provisional Application Ser. No. 63/389,495, filed on Jul. 15, 2022, the contents of which are incorporated herein by reference.

BACKGROUND

Various sanding tools exist for modifying (e.g., smoothing) surfaces such as walls, ceilings, decks, tables, etc. via abrasion. Abrading a surface causes abraded surface material to dissipate into the local environment (e.g., in the form of dust). Dissipation of the abraded material can be controlled utilizing mechanisms such as a vacuum to collect the abraded material as the sanding tool is used. Some sanding tools are configured to be coupled to a vacuum and may be referred to as vacuum sanders. Such sanding tools are often referred to as "dustless" sanders or "dust free" sanders even though a percentage of the dust created may still be dissipated into the local environment.

In various instances, a working material, which can be a sheet of abrasive (e.g., sandpaper, abrasive mesh, etc.), can be mounted onto a sanding tool. The sanding tool can be an electric/motorized sander (e.g., random orbit sander, belt sander, finishing sander, etc.) with the abrasive sheet being moved through the action of an electric motor to encourage abrasion of a surface. Motorized sanders have very specific applications including assisting in the abrasion of harder to abrade surfaces such as wood and/or metal. The motorized sanders are not always suited for abrasion of softer surfaces such as drywall compound. The motorized movement of the abrasive sheet can be too aggressive leaving the operator with little control over the amount of material being abraded away and ultimately being apt to remove too much material. Further, the abrasion of softer surfaces such as drywall compound can generate very fine dust, which unlike its more coarse counterpart generated from abrasion of harder surfaces can result in infiltration into and damage of the motorized components of the motorized sanders.

As an alternative to the electric/motorized sander, a sheet of abrasive can be mounted onto a hand sander. A hand sander can include a nonmotorized hand tool utilized to abrade a surface through the application of mechanical force generated by a human operator. Hand sanders do not include an electric motor that encourages abrasion of the surface and/or moves an abrasive sheet in relation to the surface. A hand sander can abrade a surface via an operator manually moving the abrasive sheet of the hand sander across and in contact with a surface while applying force.

DETAILED DESCRIPTION

Various types of sanding tools exist for abrading different surfaces. Many sanding tools, such as belt sanders, random orbit sanders, rotary sanders, etc. are motorized (e.g., electrically powered). While being effective for quickly removing large amounts of surface material, such motorized sanders often have a reduced ability of the operator to precisely control the movement of the tool and/or pressure applied to the working surface, which can lead to a reduced uniformity of the target surface.

Therefore, various non-motorized sanding tools can be more effective for certain applications such as drywall sanding (e.g., wall and/or ceiling sanding), for example. The use of non-motorized sanding tools can provide benefits such as allowing an operator to precisely adjust the force applied, the direction of an abrading action, the amount of material abraded away, and the uniformity of abrasion based on "feel."

Some non-motorized hand sanding tools are attached to an elongate pole used to maneuver the tool, while others may include a handle (e.g., knob) located closer to the working surface. Some non-motorized sanding tools include a port (e.g., an air intake) for coupling to a vacuum, which can be used to create a more dust free operating environment. Various non-motorized vacuum sanders may not work well with multiple different types of working materials. For instance, the "dust free" operation of some vacuum sanders may vary depending on whether a non-porous abrasive sheet or a more porous (e.g., mesh) sanding sheet is used.

Various embodiments of the present disclosure provide a sanding tool that can be configured to operate both with and without vacuum attachment. For example, various embodiments include a base plate that can be releasably attached to various different handles, which may or may not include a vacuum port. Embodiments of the present disclosure also include an intermediate adapter pad that can releasably engage with a rigid base plate in order to provide improved dust free operation for multiple different types of sanding abrasive sheets.

Figure 1A:
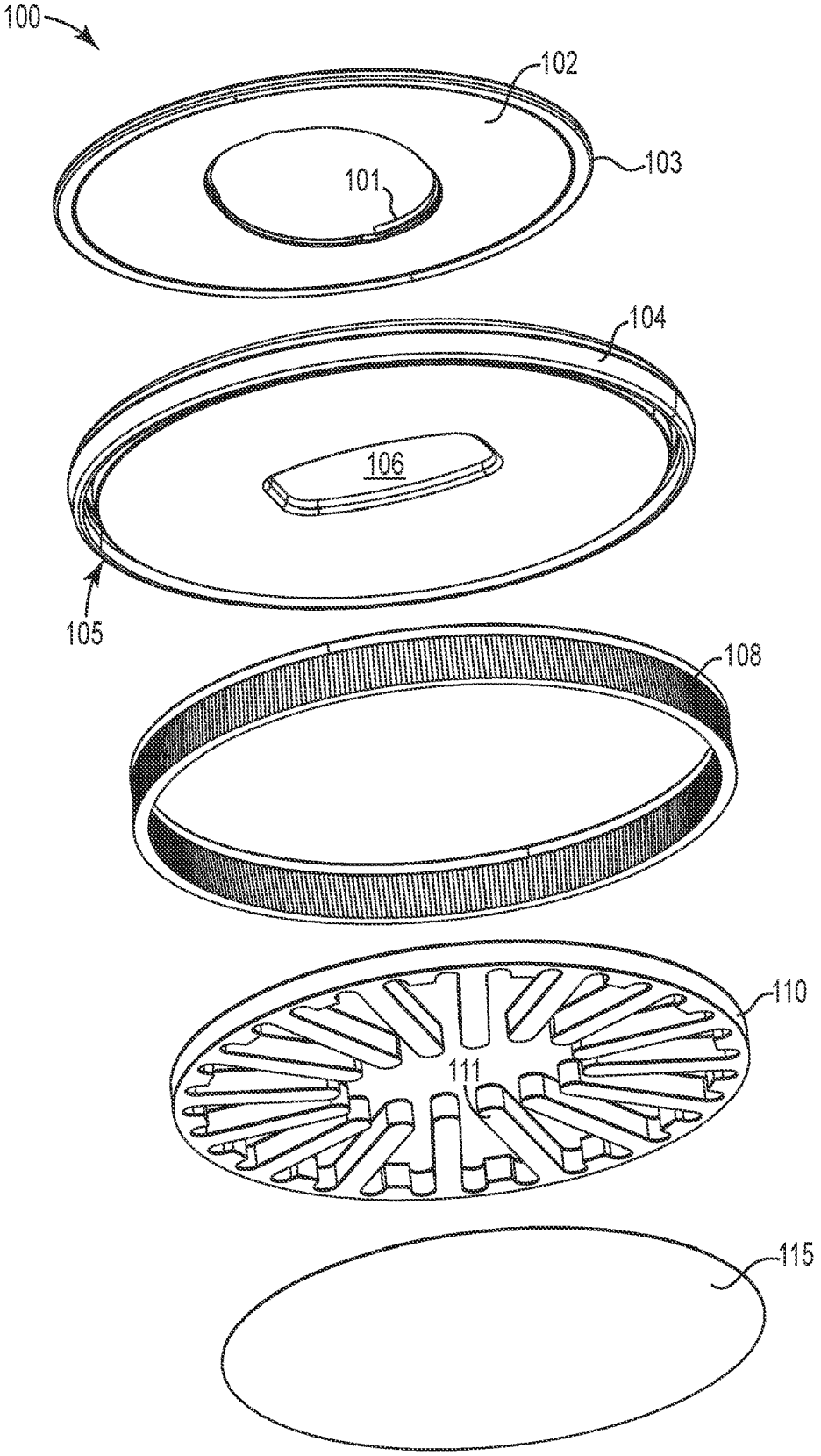
FIG. 1A illustrates an exploded view of a portion of a sanding tool having an intermediate adapter pad in accordance with various embodiments of the present disclosure.

FIG. 1A illustrates an exploded view of a portion 100 of a sanding tool having an intermediate adapter pad 104 in accordance with various embodiments of the present disclosure. In the example shown in FIG. 1A, the sanding tool includes a rigid base plate 102, an adapter pad 104, a bristle ring 108, a lower pad 110, and a working material 115.

Figure 2:
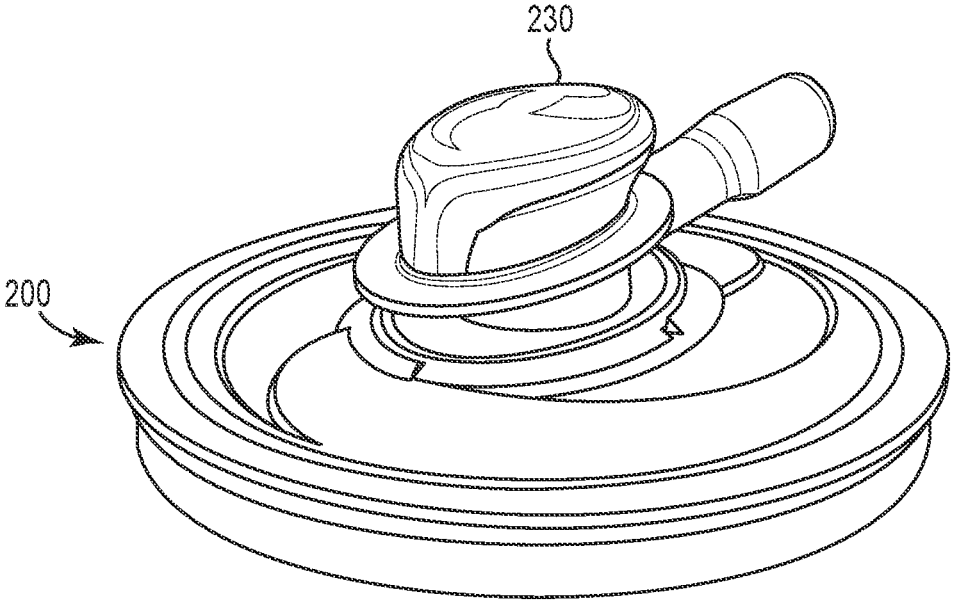
FIG. 2 illustrates an example of a sanding tool having a vacuum adapter handle coupled thereto according to various embodiments of the present disclosure.

The rigid base plate 102 includes a connection portion 101 that provides the ability for the base plate 102 to be releasably attached to various different sanding handles. One example sanding handle 230 is shown in FIG. 2. Embodiments are not limited to a particular sanding handle type. For example, in various embodiments, the base plate 102 is releasably attached to an elongate pole (not shown) via connection portion 101. As shown in FIG. 1A, the base plate has a circular shaped periphery; however, embodiments are not limited to a particular shape. In this example, the periphery of the base plate 102 includes a rubber ring 103 that can serve as a buffer for sanding applications in which the adapter pad 104 is not used. For instance, the ring 103 can reduce or prevent damage to a surface when the periphery of the rigid base plate 102 comes in contact with an adjacent surface (e.g., an intersecting wall and/or ceiling).

The rubberized ring 103 can also provide an improved frictional "grip" when releasably attached to the adapter pad 104.

Figure 1B:
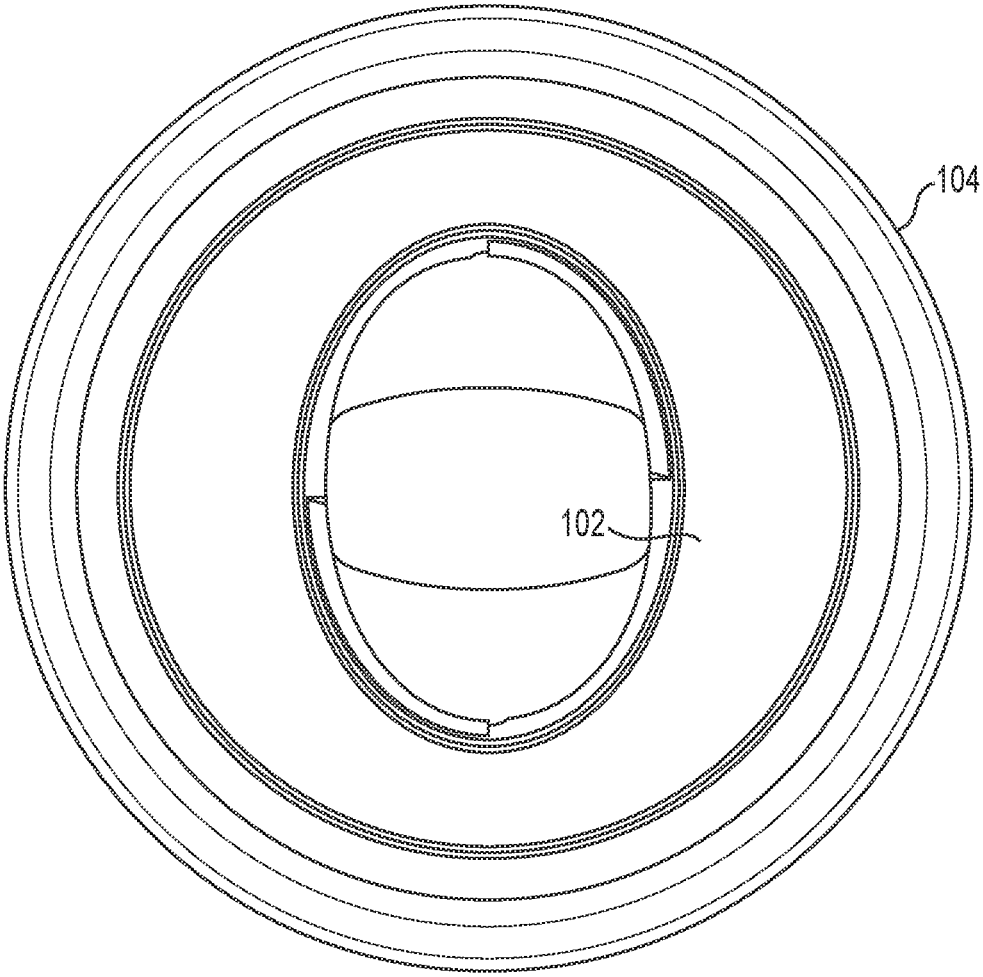
FIG. 1B illustrates an overhead view and cross sectional views of the sanding tool shown in FIG. 1A.
Figure 1B:
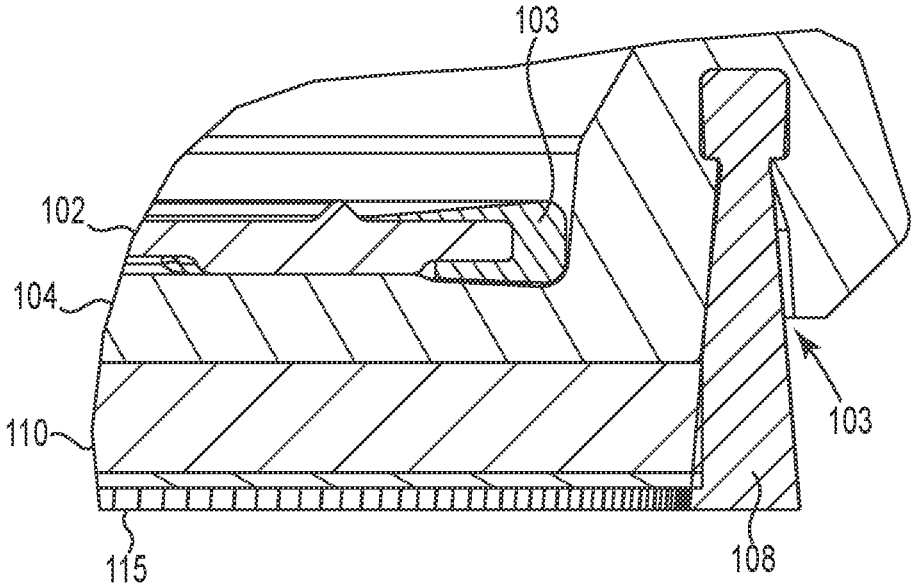

The intermediate adapter pad 104 is configured for releasable attachment to the rigid base plate 102. The pad 104 can be formed of an elastomeric polymer (e.g., a closed cell foam material such as ethylene-vinyl acetate (EVA)). As illustrated in FIG. 1B, the upper portion of the pad 104 is configured to receive the base plate 102 and includes a perimeter portion that extends above an upper surface of the base plate 102. The intermediate adapter pad 104 can be frictionally attached to the base plate 102 with the edges of the pad 104 enveloping the periphery of the base plate 102. In some instances, the lower surface of the base plate 102 and the upper surface of the pad 104 can be releasably attached via a fastening mechanism such as hook and loop (e.g., Velcro).

A lower surface of the adapter pad 104 is configured for releasable attachment to a lower pad 110, which is configured for releasable attachment to a working material 115, which can be a non-porous sanding sheet or a porous sanding sheet such as a mesh sanding disc. The releasable attachment can be via a fastening system such as hook and loop; although, embodiments are not so limited.

Figure 1C:
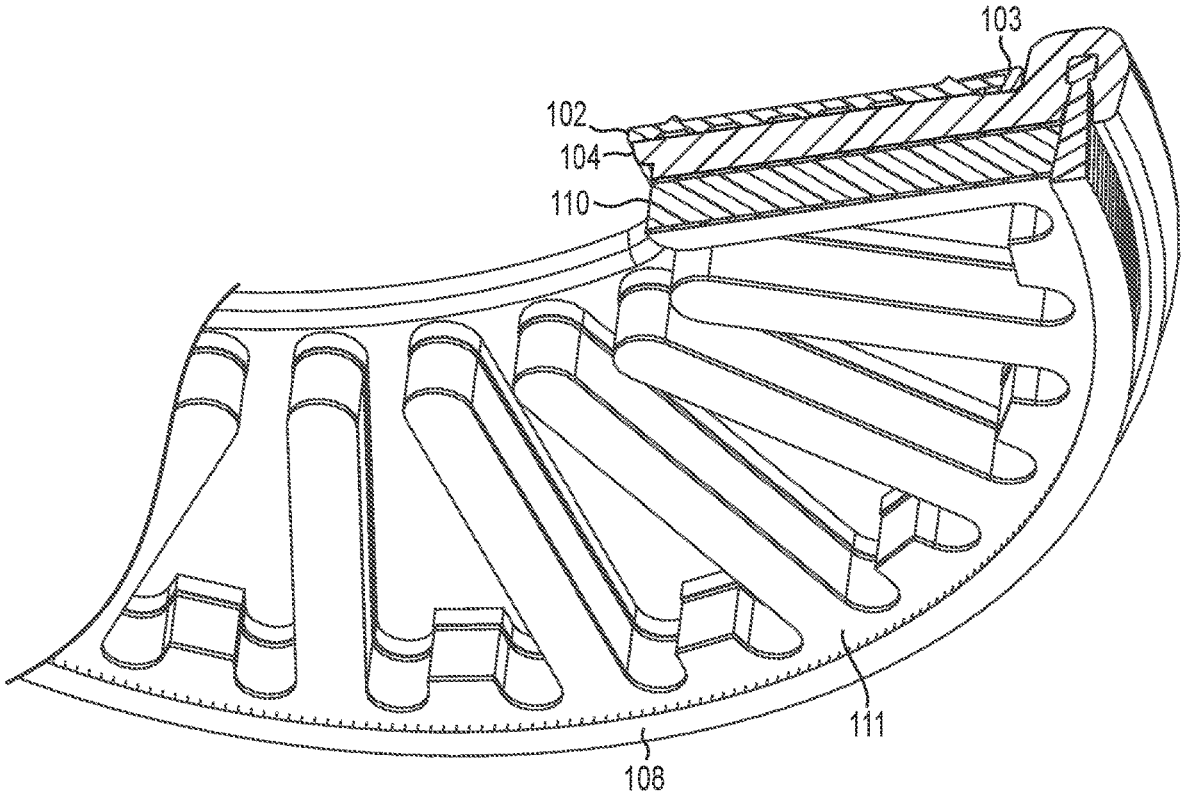
FIG. 1C illustrates a cross sectional view of a portion of the sanding tool shown in FIG. 1A.
Figure 1D:
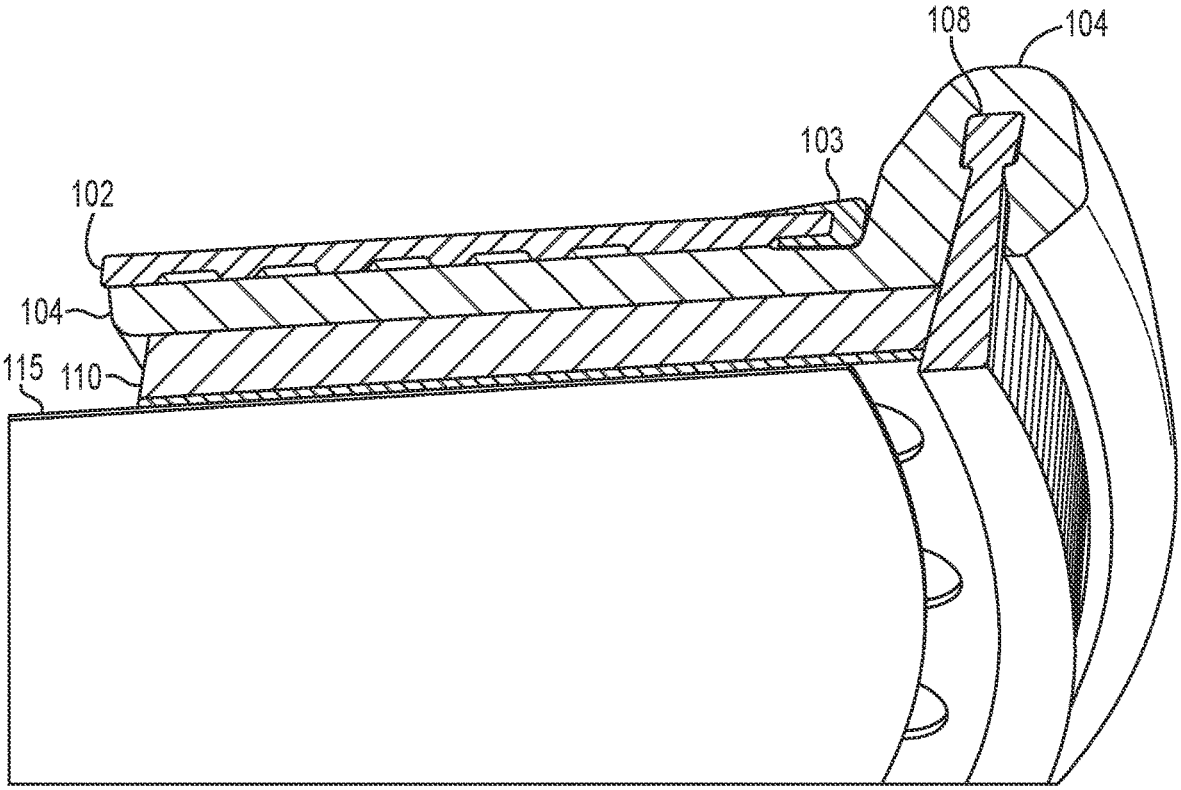
FIG. 1D illustrates a cross sectional view of a portion of the sanding tool shown in FIG. 1A.

In various embodiments, the adapter pad 104 includes a bristle ring 108 attached thereto. In this example, the adapter pad 104 includes a channel (e.g., groove) 105 configured to receive an upper portion of the bristle ring 108. The bristle ring 108 can be releasably attached to the pad 104 via friction such that it can be removed and replaced without having to remove or replace the pad 104. A more detailed view of the attachment of the bristle ring 108 to the intermediate adapter pad 104 is shown in FIGS. 1B, 1C, and 1D. The bristle ring 108 is configured to contact the working surface during operation of the sanding tool and serves to create improved dust removal from the working surface through aperture 106 in the pad 104.

The lower pad 110 includes a number of channels therethrough to facilitate dust removal from the working surface. The lower pad 110 includes a closed periphery, which can improve the dust free operation of the sanding tool. For instance, during vacuum operation, the suction at the perimeter region (e.g., between the outer edge of the pad 110 and the inner edge of the ring 108 can be improved as compared to instances in which channels through pad 110 extended to its periphery. In this example, the lower pad 110 includes an open center portion and a plurality of "fingers" 111 extending radially from the closed outer perimeter toward the center portion. Embodiments are not limited to the example pad 110 shown in FIG. 1A. For example, the pad 110 can comprise a plurality of apertures (e.g., circular apertures) to facilitate dust removal therethrough. In various embodiments, the pad 110 is formed of an open cell foam material such that it is softer and more flexible as compared to the adapter pad 104. As examples, the open cell foam can be reticulated foam, polyurethane foam, or open cell rubber.

In various embodiments, the sanding tool shown in FIG. 1A can be operated without the adapter pad 104 (and ring 108). That is, the sanding tool can be operated with the rigid base plate 102 being releasably attached to the lower pad 110 to which the sanding material 115 is releasably attached. The tool can include one or more additional pad layers releasably attached together between the pad 110 and the base 102 as well.

Accordingly, the adapter pad 104 can be a standalone component that can be added to the sanding tool to provide an improved sanding capability with improved dust free operation. As one example, without the adapter pad 104, the sanding tool 100 may provide an acceptable level of dust free operation when the sanding material 115 is a non-porous sanding sheet/disc, but an unacceptable level of dust free operation when a porous mesh sanding disc 115 is used. Adding the adapter pad 104 to the sanding tool 100 can provide an acceptable and improved level of dust free operation for both a porous sanding disc (e.g., mesh) and a non-porous sanding disc.

In various embodiments, the sanding tool 100 is configured for being converted between at least a first configuration that includes the adapter pad 104 and a second tool configuration that does not include the adapter pad 104. For example, a first tool configuration can include the rigid base plate 102 being coupled to the adapter pad 104, and a second tool configuration can include an upper surface of the lower pad 110 being releasably attached to a lower surface of the rigid base plate 102; however, embodiments are not so limited.

FIG. 1B illustrates an overhead view and cross sectional views of the sanding tool shown in FIG. 1A.

FIG. 1C illustrates a cross sectional view of a portion of the sanding tool shown in FIG. 1A.

FIG. 1D illustrates a cross sectional view of a portion of the sanding tool shown in FIG. 1A.

Figure 1E:
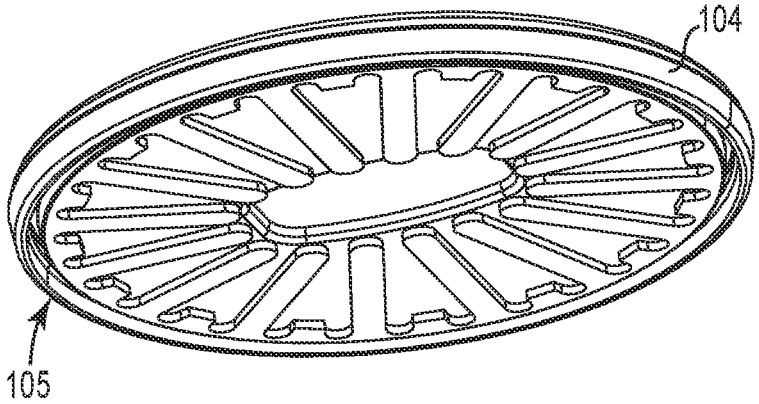
FIG. 1E illustrates an example intermediate adapter pad in accordance with various embodiments of the present disclosure.

FIG. 1E illustrates an example intermediate adapter pad in accordance with various embodiments of the present disclosure. The intermediate adapter pad 104 shown in FIG. 1E is similar to the pad 104 described in FIG. 1A with the lower portion of the pad 104 shown in FIG. 1E having a non-smooth surface. The example shown in FIG. 1E includes some notched portions creating a number of radially extending finger portions that can align with the fingers 111 of the lower pad 110, which can facilitate improved dust free operation, for example.

FIG. 2 illustrates an example of a sanding tool 200 having a vacuum adapter handle 230 coupled thereto according to various embodiments of the present disclosure. As described above, the vacuum adapter handle 230 can be releasably attached to the sanding tool base plate 102 via the connection portion 101 shown in FIG. 1A. As noted above, embodiments are not limited to a particular type of handle and/or to vacuum sanding operation.

In the present disclosure, reference is made to the accompanying drawings that form a part hereof, and in which is shown by way of illustration how a number of examples of the disclosure can be practiced. These examples are described in sufficient detail to enable those of ordinary skill in the art to practice the examples of this disclosure, and it is to be understood that other examples can be used and that process, electrical, and/or structural changes can be made without departing from the scope of the present disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure and should not be taken in a limiting sense. As used herein, the designator "N", particularly with respect to reference numerals in the drawings, indicate that a number of the particular feature and/or component so designated can be included with a number of examples of the present disclosure. The designator "N" can refer to a same feature and/or component, or different features and/or components.

As used herein, "a" or "a number of" something can refer to one or more such things. For example, "a number of widgets" can refer to one or more widgets. Also, as used herein, "a plurality of" something can refer to more than one of such things.

The above specification, examples and data provide a description of the device, method, and use of the device and method of the present disclosure. Since many examples can be made without departing from the spirit and scope of the system and method of the present disclosure, this specification merely sets forth some of the many possible embodiment configurations and implementations.

What is claimed is:

1. A hand sanding tool, comprising:

a base plate configured for releasable attachment to a number of sanding handles;

an adapter pad, comprising:

an upper portion including a central portion configured to receive a lower surface of the base plate, and a perimeter portion that extends from the central portion to above an upper surface of the base plate; and a lower surface configured for attachment to a lower pad, wherein a lower surface of the lower pad is configured for attachment to a working material; and wherein the perimeter portion includes a channel configured to receive a bristle ring; and wherein a periphery of the base plate is in contact with the perimeter portion.

2. The hand sanding tool of claim 1, wherein the adapter pad is made of a closed cell foam material and the lower pad is made of an open cell foam material.

3. The hand sanding tool of claim 2, wherein the closed cell foam material is an elastomeric polymer.

4. The hand sanding tool of claim 3, wherein the elastomeric polymer is ethylene-vinyl acetate (EVA).

5. The hand sanding tool of claim 1, wherein the number of sanding handles includes an elongate pole.

6. The hand sanding tool of claim 1, wherein at least one of the number of sanding handles comprises a vacuum attachment handle.

7. The hand sanding tool of claim 1, wherein the bristle ring is releasably attached to the adapter pad via the channel such that the bristle ring is replaceable without replacing the adapter pad.

8. The hand sanding tool of claim 1, wherein the upper portion of the adapter pad is configured for frictional attachment to the base plate.

9. The hand sanding tool of claim 1, wherein the lower surface of the adapter pad is configured for releasable attachment to the lower pad.

10. The hand sanding tool of claim 9, wherein the lower surface of the lower pad is configured for releasable attachment to the working material.

11. The hand sanding tool of claim 1, wherein the lower pad comprises:

a number of channels therethrough; and a closed outer perimeter.

12. The hand sanding tool of claim 11, wherein the lower pad comprises:

an open center portion; and a plurality of fingers extending radially from the closed out perimeter toward the open center portion.

13. The hand sanding tool of claim 1, wherein the adapter pad includes a number of radially extending finger portions configured to align with a plurality of fingers of the lower pad.

14. The hand sanding tool of claim 1, wherein the adapter pad and the base plate have a circular shaped periphery.

15. The hand sanding tool of claim 1, wherein the sanding tool is configured to provide dustless operation when coupled to a handle having a vacuum adapter when the working material is a nonporous sanding sheet and when the working material is a porous mesh sanding sheet.

16. A hand sanding tool, comprising:

a base plate configured for releasable attachment to a number of sanding handles;

wherein the hand sanding tool is configured for conversion between at least a first tool configuration that includes an adapter pad and a second tool configuration that does not include the adapter pad, wherein the first tool configuration includes the base plate being coupled to the adapter pad, the adapter pad, comprising:

an upper portion configured to receive the base plate, the upper portion including a perimeter portion that extends above an upper surface of the base plate; and a lower surface configured for attachment to a lower pad, wherein a lower surface of the lower pad is configured for attachment to a working material;

wherein the perimeter portion includes a channel configured to receive a bristle ring; and wherein, the second tool configuration includes an upper surface of the lower pad being releasably attached to a lower surface of the base plate.

17. The hand sanding tool of claim 16, wherein the first configuration provides increased dustless sanding operation as compared to the second configuration.

18. The hand sanding tool of claim 16, wherein the first configuration includes at least one additional pad located between the adapter pad and the lower pad.

19. A hand sanding tool, comprising:

a base plate;

a vacuum attachment handle releasably attached to the base plate; and an adapter pad, comprising:

an upper portion including a central portion configured to receive the base plate, and a perimeter portion that extends from the central portion to above an upper surface of the base plate, and in contact with a periphery of the base plate; and a lower surface configured for attachment to a lower pad, wherein a lower surface of the lower pad is configured for attachment to a working material; and wherein the perimeter portion is configured for attachment to a bristle ring.

20. The hand sanding tool of claim 19, wherein the lower surface of the adapter pad is configured for releasable attachment to the lower pad, and wherein the lower surface of the lower pad is configured for releasable attachment to the working material.

* * * * *